US007188481B2

(12) United States Patent
DeYoe et al.

(10) Patent No.: US 7,188,481 B2
(45) Date of Patent: Mar. 13, 2007

(54) ADJUSTABLE DAMPER ACTUATOR

(75) Inventors: Donald A. DeYoe, Newmarket (CA); Richard C. Tsou, Etobicoke (CA)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/283,819

(22) Filed: Oct. 30, 2002

(65) Prior Publication Data

US 2004/0084542 A1 May 6, 2004

(51) Int. Cl.
*F25B 1/00* (2006.01)

(52) U.S. Cl. ..... 62/115; 62/186; 62/408; 236/49.3

(58) Field of Classification Search ..... 62/493, 62/186, 187, 408; 251/285, 286, 305, 129.11, 251/129.1; 236/45, 49.5, 1 G, 49.3; 138/44–46, 138/37, 40; 110/163; 165/69; 445/42, 265; 454/266, 311, 333–347, 361, 42, 265; 137/37
See application file for complete search history.

(56) References Cited

U.S. PATENT DOCUMENTS 23,902 A * 5/1859 Cope et al. ..... 137/259
105,925 A * 8/1870 James ..... 251/285
2,414,947 A * 1/1947 Heinze ..... 137/47
2,761,647 A * 9/1956 Zeck ..... 251/225
2,965,354 A * 12/1960 Grove et al. ..... 251/173
3,750,780 A * 8/1973 Danek ..... 477/206
3,807,709 A * 4/1974 Suda et al. ..... 261/39.2
4,090,434 A * 5/1978 Krisko et al. ..... 454/264
4,177,716 A * 12/1979 Bowe et al. ..... 118/326
4,292,802 A * 10/1981 Snow ..... 60/204
4,364,301 A * 12/1982 Kawabata et al. ..... 91/20
4,372,485 A * 2/1983 McCabe ..... 236/1 G
4,407,264 A * 10/1983 Pettorino ..... 126/518
4,424,799 A * 1/1984 Patterson ..... 126/289
4,458,583 A * 7/1984 Fukui et al. ..... 454/75
4,531,450 A * 7/1985 Yamada et al. ..... 92/37
4,556,194 A * 12/1985 van Lingen ..... 251/129.12
4,557,418 A * 12/1985 Leemhuis ..... 236/49.3
4,691,689 A 9/1987 Shepherd et al.
4,834,282 A * 5/1989 Tenorio et al. ..... 236/1 G
4,844,115 A * 7/1989 Bowers ..... 137/240
5,020,423 A * 6/1991 Hill ..... 454/319
5,096,156 A * 3/1992 Wylie et al. ..... 251/77
5,117,900 A * 6/1992 Cox ..... 165/53

(Continued)

FOREIGN PATENT DOCUMENTS

CH NR. 320865 * 4/1957

(Continued)

OTHER PUBLICATIONS

Thermostatically Controlled Radiator Valve (Translated vertion in Emglish language). 12 pages including the cover page.*

*Primary Examiner*—Mohammad M. Ali

(57) ABSTRACT

An actuator for controlling the position of a damper. It is an adjustable damper actuator that can actuate a damper to have positions that are other than fully open and fully closed. The actuator has adjustable stops for attaining a partially closed or partially open damper as the operator wants. This actuator is useful for zone heating and air-conditioning as well as for providing a continuous supply of make-up air at low flow rates.

40 Claims, 11 Drawing Sheets

U.S. PATENT DOCUMENTS 5,139,230 A * 8/1992 Lester ..... 251/285
5,151,063 A * 9/1992 Tanaka et al. ..... 454/258
5,169,121 A * 12/1992 Blanco et al. ..... 251/129.12
5,251,815 A * 10/1993 Foye ..... 236/49.3
5,429,090 A * 7/1995 Kotchi et al. ..... 123/396
5,513,611 A * 5/1996 Ricouard ..... 123/399
5,775,415 A * 7/1998 Yoshimi et al. ..... 165/202
5,876,014 A * 3/1999 Noritake et al. ..... 251/129.12
5,921,277 A 7/1999 Bernal
5,983,890 A * 11/1999 Thomas et al. ..... 126/512
6,105,927 A * 8/2000 Zelczer et al. ..... 251/58
6,140,626 A * 10/2000 McKee et al. ..... 219/681
6,164,623 A * 12/2000 Ito et al. ..... 251/305
6,181,557 B1 * 1/2001 Gatti ..... 361/695
6,198,243 B1 * 3/2001 Ritmanich et al. ..... 318/466
6,244,564 B1 * 6/2001 Noritake ..... 251/129.11
6,364,211 B1 * 4/2002 Saleh ..... 236/49.3
6,418,891 B2 * 7/2002 Kobayashi ..... 123/73 PP
6,446,539 B1 * 9/2002 Niessen ..... 92/13.5
6,557,826 B2 * 5/2003 Moore et al. ..... 251/305

FOREIGN PATENT DOCUMENTS

JP 363112209 A * 5/1988
JP 402021076 A * 1/1990
JP 10-300182 * 11/1998

* cited by examiner

ADJUSTABLE DAMPER ACTUATOR

BACKGROUND

The invention pertains to heating and air conditioning systems. Particularly, it pertains to dampers which may be used in such systems. More particularly, the invention pertains to damper actuators.

Dampers in heating, ventilation and air condition (HVAC) systems typically control air flow in full open and full closed positions. There has been a need for a low cost damper actuator which can control air flow in an HVAC system or other systems with dampers having some variable open and closed positions.

SUMMARY

The present invention is a low cost adjustable damper actuator that can actuate a damper to have positions that are other than fully open and fully closed. Mainly, the actuator provides the convenience of adjusting damper opening for make-up air without guess work. Such actuator would be useful for zone heating and air conditioning as well as for providing a continuous supply of make-up air at low flow rates. The actuator has stops which can be set to prevent full rotational or linear travel of the damper to be driven. Adjustable stops or other mechanisms are provided to limit damper travel in the opening direction and/or travel in the closing direction. The actuator has a mover mechanism, a damper moving mechanism connected to the mover mechanism, and a movement limiting mechanism connected to the moving mechanism.

DESCRIPTION

Figure 1:
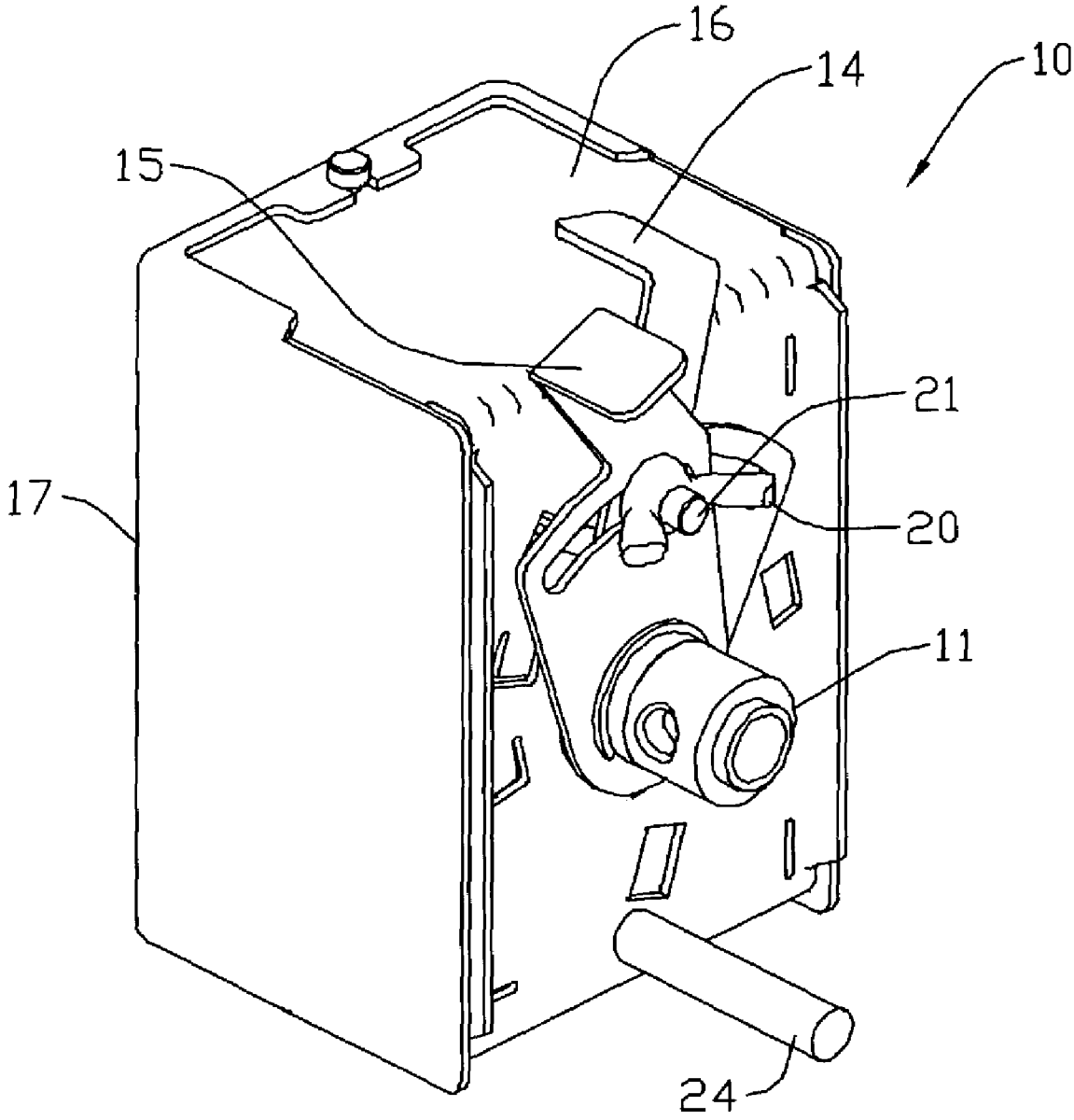
FIG. 1 shows a perspective view of the adjustable damper actuator.
Figure 2A:
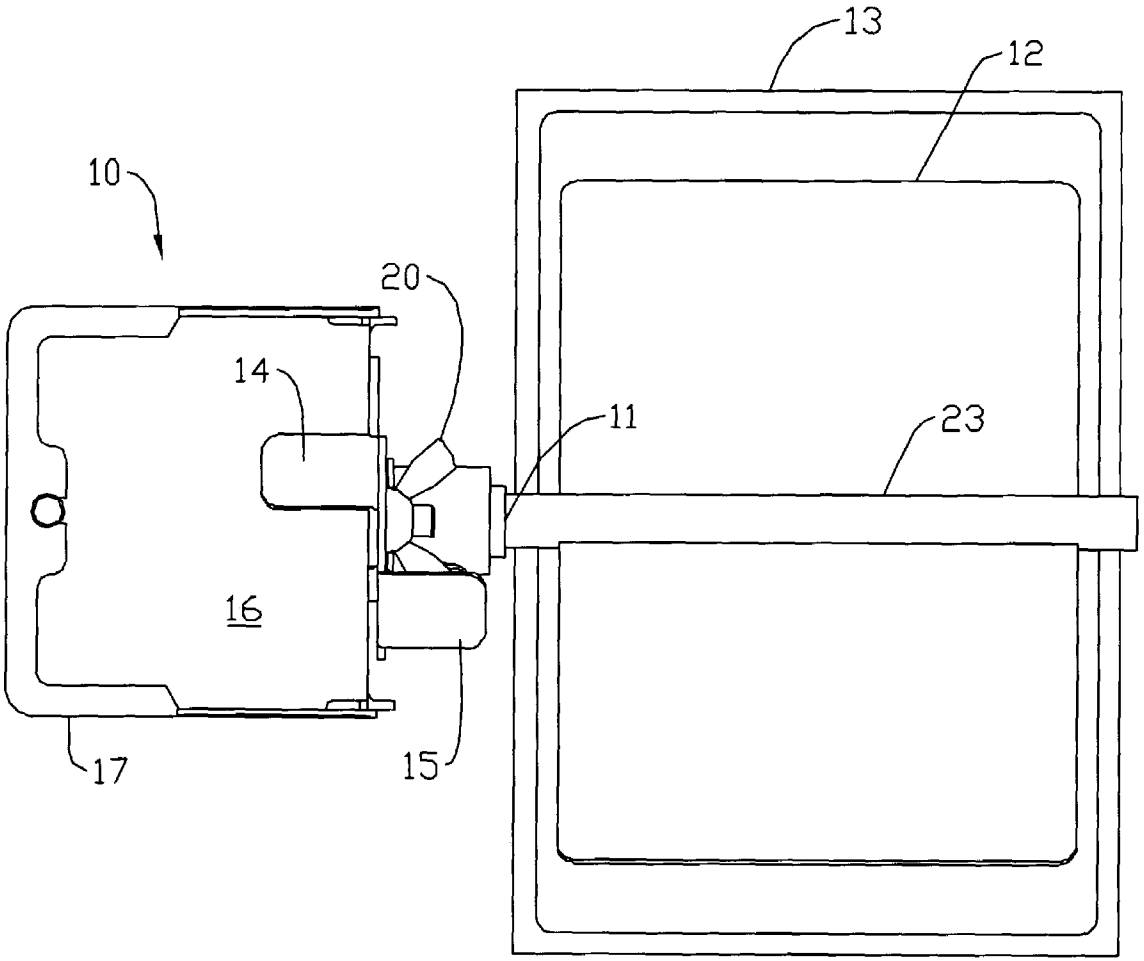
FIG. 2*a* illustrates the actuator with a partially closed damper.
Figure 2B:
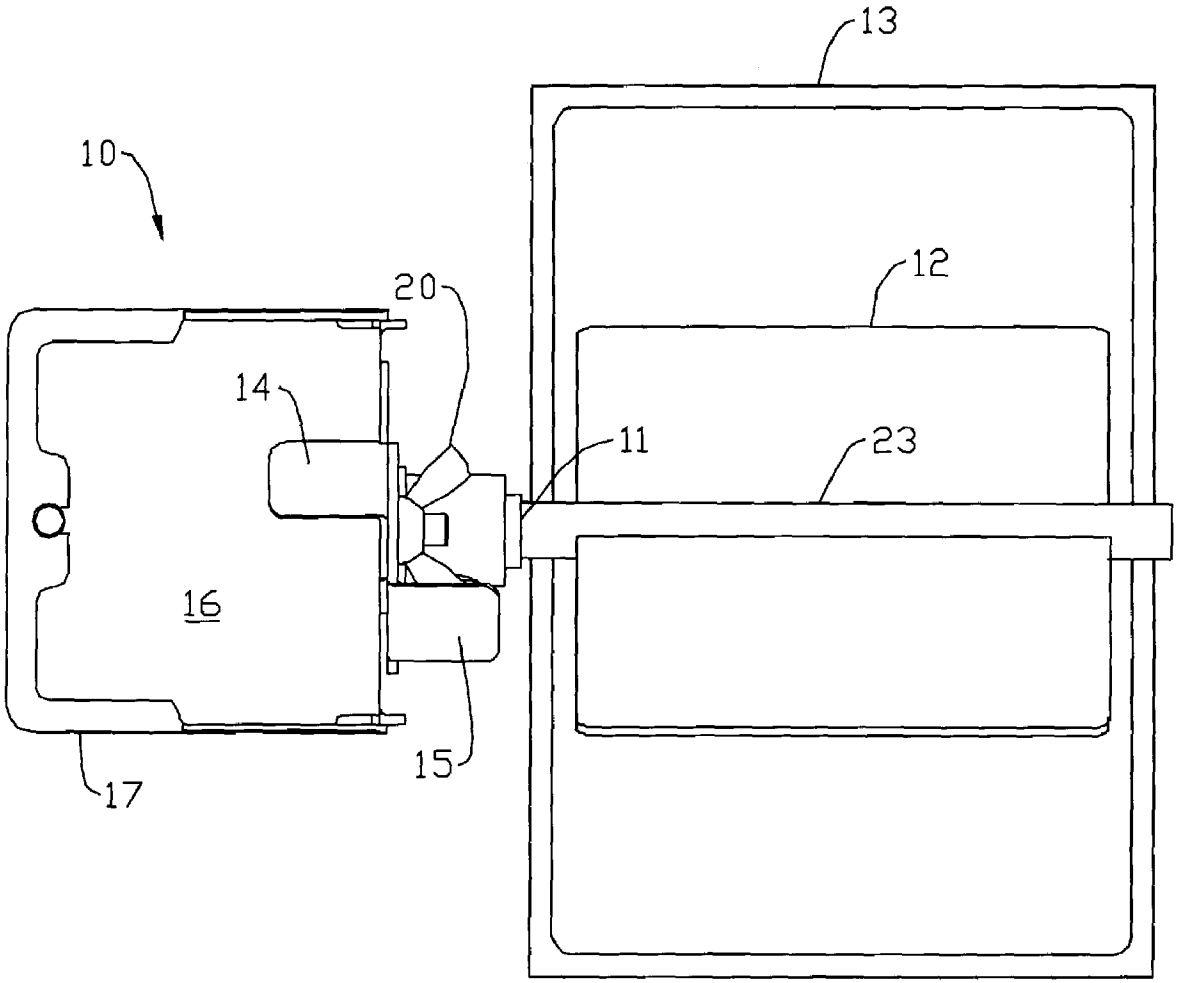
FIG. 2*b* illustrates the actuator with a partially open damper.
Figure 2C:
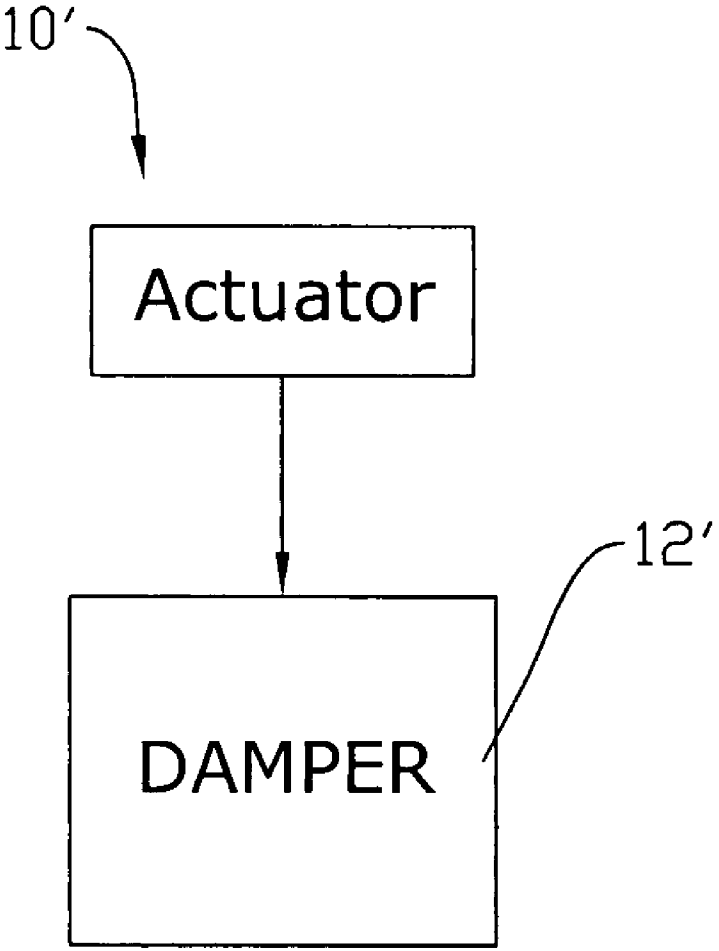
FIG. 2*c* is a schematic view showing an actuator adapted to control a damper in accordance with the present invention.

FIG. 1 is an illustration of an adjustable direct drive damper actuator 10. Actuator 10 has an output shaft 11, which may be connected to a damper 12 shown in FIG. 2. Shaft 11 may rotate damper 12 to one of two desired adjusted positions in a vent or duct 13 in an HVAC system. Shaft 11 is coupled to shaft 23 of damper 13. These positions may be those that are other than a full open or full closed position. FIG. 2*a* shows damper 12 to be in a partially closed position. FIG. 2*b* shows damper 12 to be in a partially open position. The damper 12 of FIG. 2*a* and 2*b* is shown as a rotational device. However, and as shown in FIG. 2*c*, it is contemplated an actuator 10' with one or more stops may control a damper 12' of any suitable type, such as a rotational damper of various shapes, a laterally sliding device, and/or any other suitable shutting and opening mechanism, as desired. The damper positions shown in FIG. 2*a* and 2*b* may be referred to an adjusted partially closed position and an adjusted partially fully open position, respectively. For instance, such positions of the damper may be useful for situations calling for zone heating and air conditioning as well as providing for a continuous supply of make-up air at low flow rates.

Figure 3:
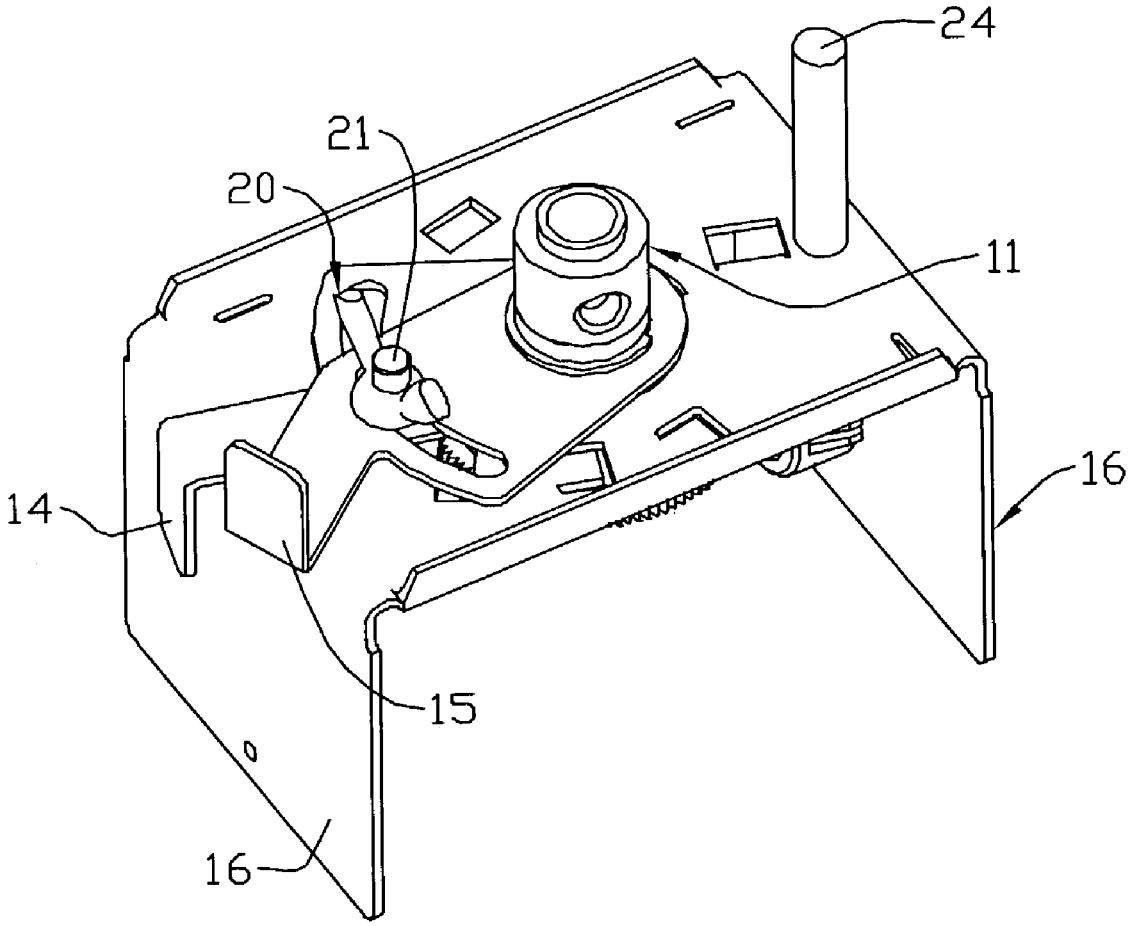
FIG. 3 shows adjustment levers of the actuator.
Figure 4:
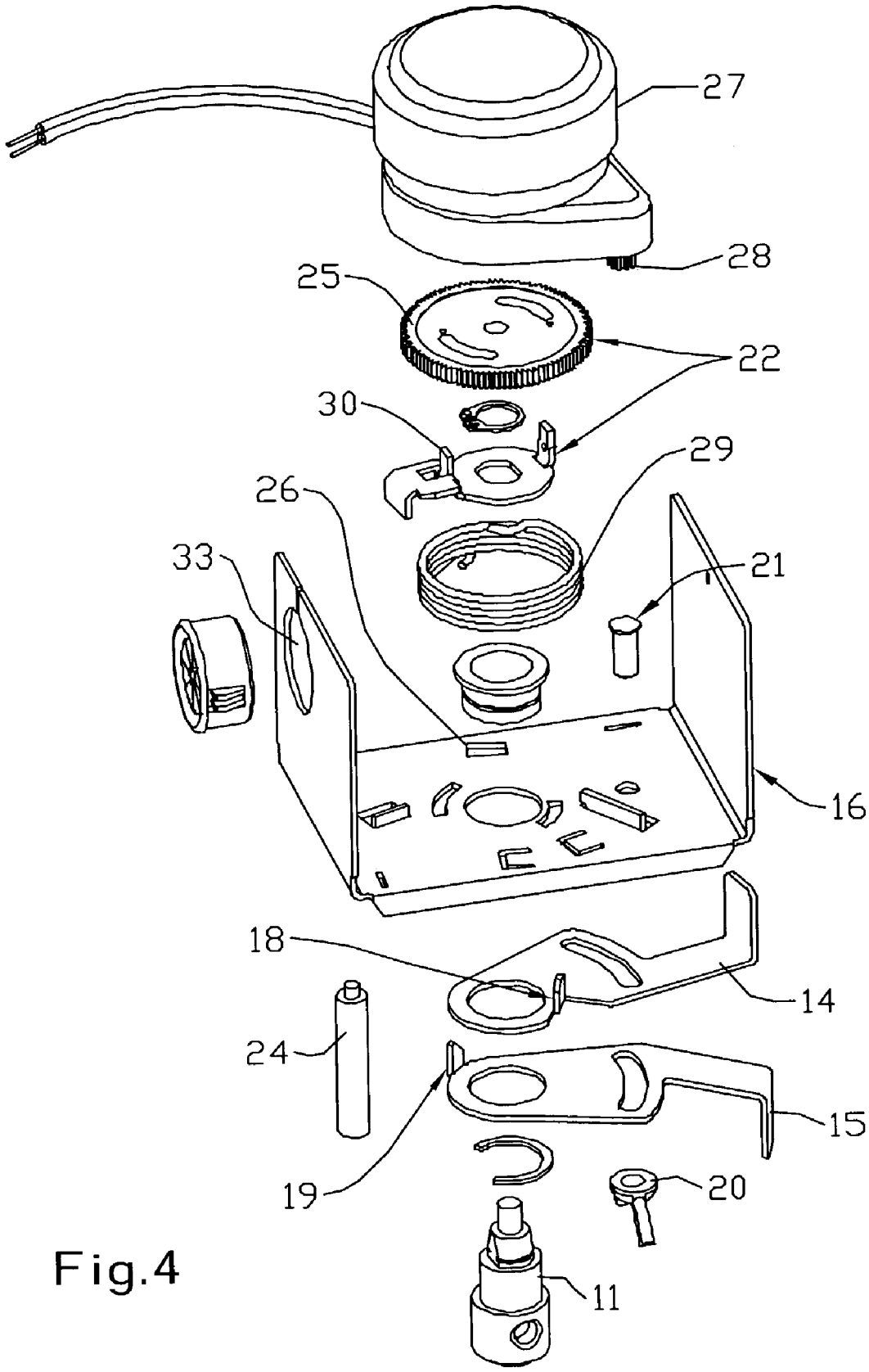
FIG. 4 is an exploded view of the actuator.
Figure 5:
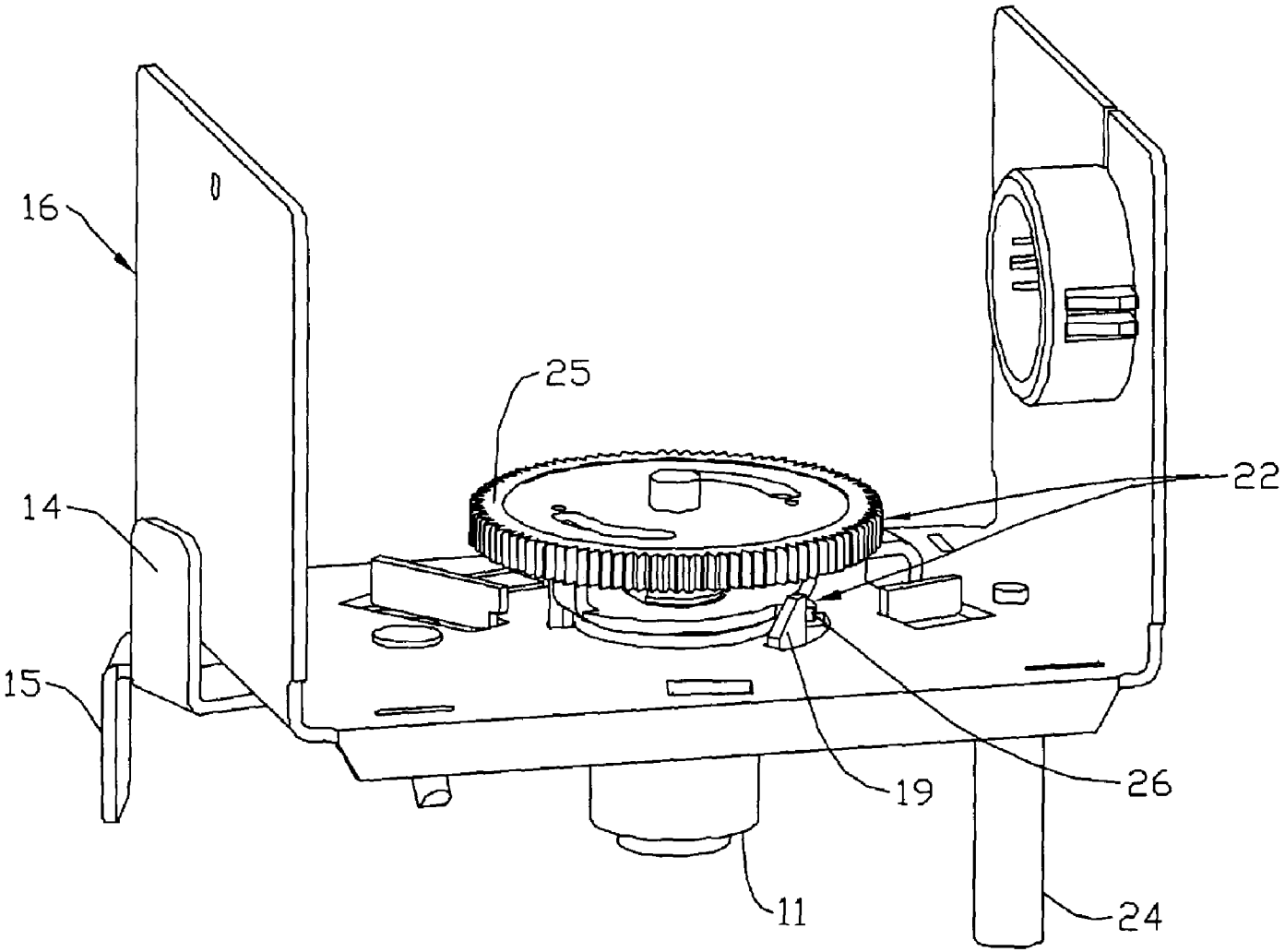
FIG. 5 shows the inside of the actuator with the case cover and motor removed.

Two adjustable positions may be attained with mechanical stops that can be adjusted. The stops can be manually set to prevent full rotational travel of shaft 11 of motor drive actuator 10. The adjustable stops are provided to limit the travel of shaft 11 and damper 12 in the opening direction and/or in the closing direction of damper 12. The adjustable feature may be obtained with the use of levers 14 and 15 which may set to limit rotation of drive shaft 11 of actuator 10. Levers 14 and 15 are accessible exterior to case 16 and case cover 17. FIG. 3 reveals actuator 10 with case cover 17 removed from case 16. Each lever 14 and 15 has a tab 18 and 19, respectively, which also may be regarded as an adjustable stop, as shown as an exploded view in FIG. 4. Tabs or stops 18 and 19 may interfere with a drive mechanism 22 of device 11 illustrated in FIG. 5. FIG. 5 is a view of internal workings of actuator 10 with case cover 17 and a motor 27 removed. As lever 14 or 15 is manually rotated, tab 18 or 19 moves thereby changing the position where actuator shaft 11 comes to a halt. Once lever 14 or 15 is set to a desired position, it may be secured or fixed to that position by a wing nut 20. By turning wing nut 20 clock-wise down tight on a threaded shaft 21 mounted firmly to case 16, or some other lever-securing mechanism, levers 14 and 15 may be secured in a non-moveable fashion relative to case 16. Adjustable stops 18 and 19 may be located internal or externally relative to case 16.

When shaft 11 of actuator 10 rotates relative to case 16, it may rotate shaft 23 and in turn damper 12 relative to vent or duct 13 provided that case 16 does not move relative to vent 13. To prevent such movement, an anti-rotation rod 24 is attached to case 16, and rod 24 may be inserted into a hole in vent or duct 13 or other like mechanism secured to vent 13.

Motor 27 has an output gear 28 that meshes with gear 25 of drive mechanism 22. Gear 28 of motor 27 turns gear 25 which is attached to shaft 11. Shaft 11 is turned by gear 25. Shaft 11 turns shaft 23 and damper 12 to a partially closed or partially open position, as approximately shown in FIGS. 2*a* and 2*b*, respectively. Motor 27 continues to move damper 12 until a tab 26 of drive mechanism hits adjustable stop 18 or 19. Tab 26 is in some form attached to drive shaft 11 so that it cannot rotate or move relative to shaft 11. When tab 26 hits stop 18 or 19, then gears 28 and 25, shafts 11 and 23, and damper 12 come to a stop or stand still.

Damper 12 may be in a partially closed or partially open position. Motor 27 may remain on or energized even though gear 28 and the rotor of motor 27 are not rotating. However, motor 27 through drive mechanism 22 and shafts 11 and 23, maintains damper 12 in the position it was driven to. In this position, shaft 11 is held by motor 27 against a return tension of a spring 29. Spring 29 has one end connected to case 16 and its other end connected to a tab 30 which is securely fastened to shaft 11. Tab 30 moves or rotates with shaft 11. Once motor 27 is turned off, deenergized or disconnected from its electrical power source, then shaft 11 returns back due to the tension of spring 29 pulling on tab 30. Tab 26 rotates with shaft 11 and hits stop 19 or 18 and shaft 11 comes to halt or stop.

Damper 12 is then in the other position depending on whether actuator 10 is installed in the power closed mode or the power open mode. That is, energized motor 27 moves damper 12 towards the closed position when actuator 10 is installed in the power close mode, and vice versa.

Figure 6:
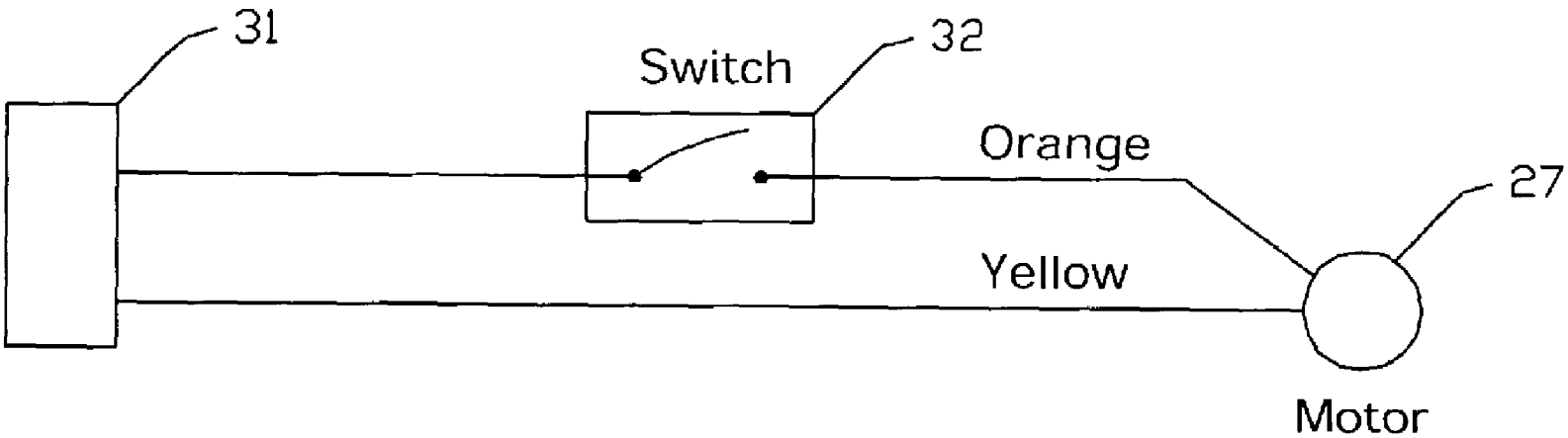
FIG. 6 is a schematic of the actuator motor electric power connection.

FIG. 6 shows the diagram for connecting motor 27 to electrical power source 31. The power required is 24 volts AC at 60 hertz with nominal current of 0.32 amperes. Operation of motor 27 may be controlled with a zone switch 32. Wires with power for motor 27 may be fed through a conduit hole 33 in case 16.

Motor 27, when energized, results in about 423 mNm (milli-Newton-meters), i.e., 60 inch-ounces, of torque to shaft 11 when spring 29 is returned to its initial start position. A typical time for motor 27 to move shaft 11 and damper 12 from one position to the other position, is about 30 seconds. To return back to the first position with motor 27 deenergized and under spring 29 return tension, takes about 10 seconds. The direction of shaft 11 is clockwise when motor 27 is energized and with device 10 being viewed from the base end.

Nominal angular rotation of shaft 11 is about 90 degrees but can be expanded to a maximum of about 105 degrees to get full opening and closing, covering 90 degrees of rotation, lower adjustment lever 15 is moved to the extreme left and upper adjustment lever 14 is moved to the extreme right.

Air flow adjustments may be made by adjusting levers 14 and 15. The following description indicates the adjustments available with actuator 10 installed in the power closed mode. If damper 12 that one is installing and adjusting is to operate in the power open mode, then the functions of upper lever 14 and lower lever 15 are reversed. When viewed on end as in FIG. 7, lower lever 15 is normally positioned to the extreme left. This position allows damper 12 to fully open 90 degrees when motor 27 is deenergized. To restrict the air flow in the open position, one may loosen but not remove wing nut 20 and move lower lever 15 to the right until a desired open position of damper 12 is reached. Then one should tighten wing nut 20 to retain this adjustment. With lower lever 15 in the extreme right position, damper 12 should open approximately 50 degrees with motor 27 deenergized.

Figure 7:
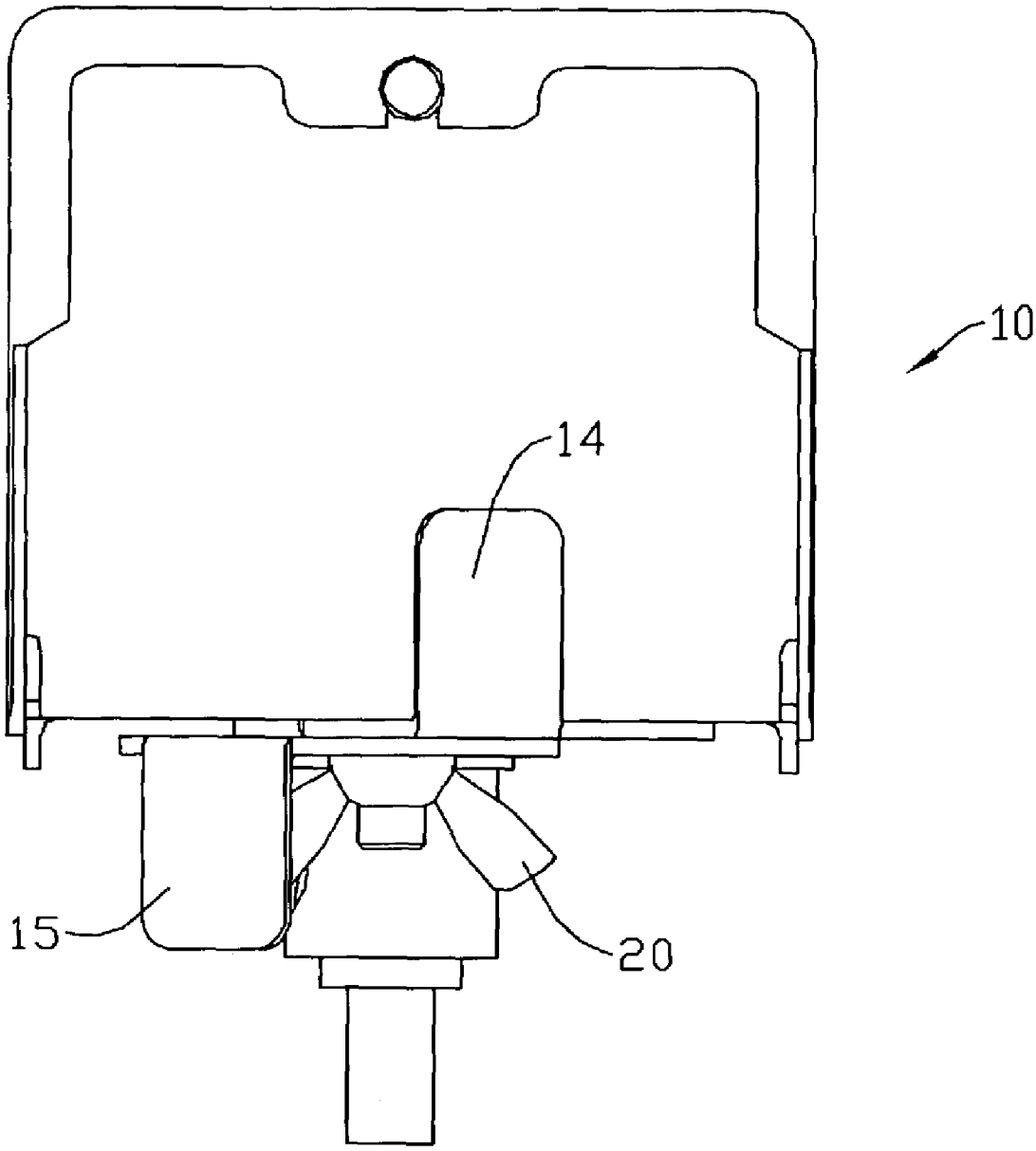
FIG. 7 is an end view of the actuator for adjustment purposes.

Upper lever 14 is normally positioned to the right, as in FIG. 7, to provide complete shut off of vent 13 by damper 12 when motor 27 of actuator 10 is energized. If desired, to prevent complete closure by damper 12, one may loosen but not remove wing nut 20 and move upper lever 14 to the left until the desired position of semi-closed damper 12 is achieved. To maintain that position, one may tighten wing nut 20. With upper lever 14 in the extreme left position, damper 12 should close to approximately 40 degrees when motor 27 is energized.

If additional rotation of damper 12 is required beyond 90 degrees, an addition 15 degrees may be obtained by removing upper lever 14. To do this, one may first disconnect actuator 10 from damper 12 and remove it from vent 13. Then one may remove wing nut 20, the retaining ring and levers 14 and 15. Next one may reassemble actuator 10 without lever 14, and install it on vent 13 with shaft 11 coupled to shaft 23 of damper 12.

Figure 8:
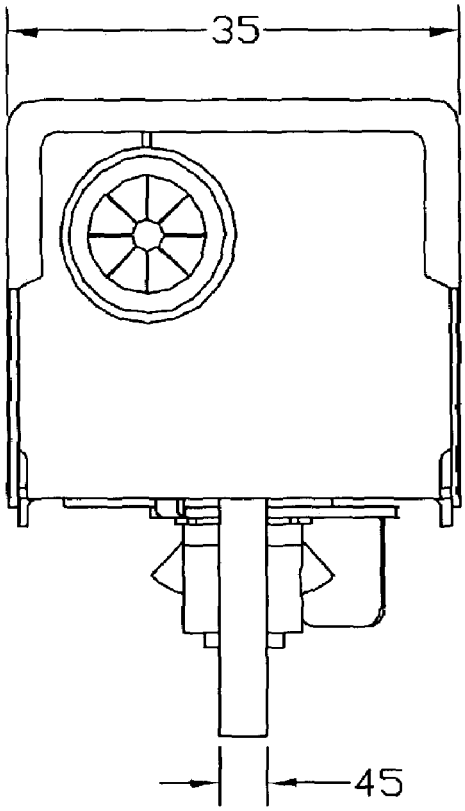
FIGS. 8, 9 and 10 show the various dimensions noted in the description.
Figure 9:
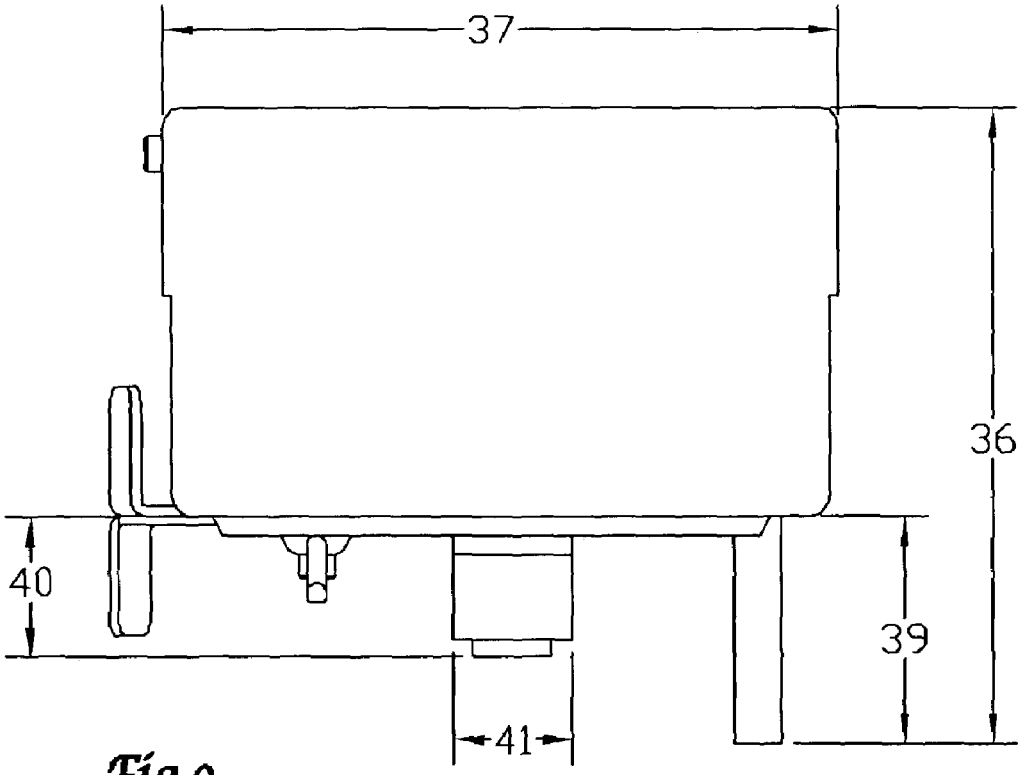
Figure 10:
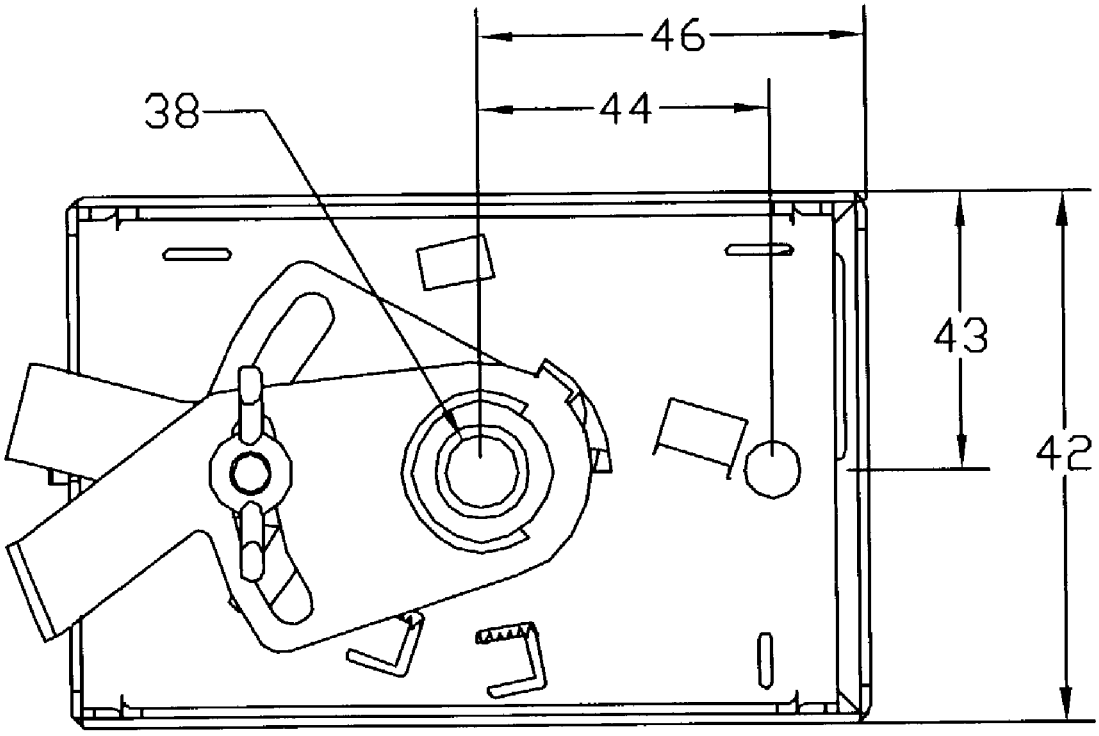

Much of the structure of actuator 10 may be made from zinc plated stamped out steel and anonized aluminum. Besides being of low power, actuator 10 is also fairly compact. FIGS. 8, 9 and 10 illustrate the various dimensions given below. Dimension 35 is 60 millimeters (mm)/2⅜ inches (in). Dimension 36 is 84.5 mm (3⅜ in); dimension 37 is 88 mm (3½ in); dimension 38 is 8.2 mm (5/16 in) in diameter; dimension 39 is 31.5 mm (1¼ in); dimension 40 is 19.3 mm (¾ in); dimension 41 is 15.8 mm (⅝ in); dimension 42 is 58.6 mm (2 5/16 in); dimension 43 is 29.3 mm (1 3/16 in); dimension 44 is 33.5 mm (1 5/16 in); dimension 45 is 6.4 mm (¼ in); and dimension 46 is 40.4 mm (1 9/16 in).

Motor 27 may be substituted with a solenoid, a fluid or vacuum driven device, or some other kind of mover mechanism. Damper 12 may be a rotational device of various shapes, a laterally sliding device or some other shutting and opening mechanism.

Although the invention has been described with respect to at least one illustrative embodiment, many variations and modifications will become apparent to those skilled in the art upon reading the present specification. It is therefore the intention that the appended claims be interpreted as broadly as possible in view of the prior art to include all such variations and modifications.

What is claimed is:

1. A damper actuator for actuating a damper in a vent or duct, the damper having a fully open and a fully closed position, the damper actuator comprising:

a drive shaft for moving the damper during normal operation of the damper;

a drive mechanism for driving said drive shaft, wherein said drive mechanism is a motor for rotating said drive shaft in a first direction;

a first adjustment lever for permitting said drive shaft to rotate a certain amount in the first direction during normal operation of the damper as determined by a set adjustment of the first adjustment lever;

a second adjustment lever for permitting said drive shaft to rotate an amount in a second direction during normal operation of the damper as determined by a set adjustment of the second adjustment lever; and a spring for providing rotational tension to said drive shaft in the second direction.

2. The actuator of claim 1, wherein:

the first adjustment lever is set to prevent the damper from reaching the fully closed position; and the second adjustment lever is set to prevent the damper from reaching the fully open position.

3. The actuator of claim 1, wherein;

rotating said drive shaft in the first direction moves the damper to a first position; and rotating said drive shaft in the second direction moves the damper to a second position.

4. The actuator of claim 3, wherein:

when said motor is energized, the damper is moved to the first position; and when said motor is de-energized, the rotational tension on said drive shaft moves the damper to the second position.

5. The actuator of claim 4, wherein:

the first position is an adjusted less than fully open position of the damper; and the second position is an adjusted less than fully closed position of the damper.

6. The actuator of claim 1, wherein said drive mechanism is a solenoid.

7. The actuator of claim 1, wherein said drive mechanism is a fluid driven actuator wherein the fluid is a liquid or a gas.

8. The actuator of claim 2, wherein said drive mechanism is a vacuum driven actuator.

9. The actuator of claim 1, wherein the damper is a rotational butterfly damper.

10. The actuator of claim 1, wherein the damper is laterally moveable shutter.

11. An apparatus for adjustably actuating a damper using a motor, comprising:

a drive shaft configured to move a damper during normal operation of the damper, the drive shaft having an axis;

a first lever configured to stop the damper in an adjustably set first position during normal operation of the damper; and a second lever configured to stop the damper in an adjustably set second position during normal operation of the damper, wherein said first and second levers rotate about an axis substantially parallel to the axis of the drive shaft to adjustably set the first and second positions, respectively, of the damper.

12. The apparatus of claim 11, further comprising:

a single locking mechanism for adjusting the set first and second positions.

13. The apparatus of claim 12, wherein the single locking mechanism is configured such that when the locking mechanism is in a locked position, the first and second levers are locked, and when the locking mechanism is in an unlocked position, the first and second levers are separately freely rotatable such that the first lever can be moved to stop the damper in the first position, and the second lever can be moved to stop the damper in the second position.

14. The apparatus of claim 13, further comprising means for controlling zone heating and air conditioning connected to said drive shaft.

15. A method for adjustably actuating a damper during normal use of the damper comprising:

sliding a first adjustment lever in a planar arc to set a first position of the damper;

sliding a second adjustment lever in a planar arc to set a second position of the damper;

locking said first and second adjustment levers in place; and moving the damper to the first position or second position during normal use of the damper.

16. The method of claim 15, further comprising controlling zone heating and air conditioning by moving the damper to the first or second position during normal use of the damper.

17. The method of claim 16, further comprising re-adjusting the first and second adjustment levers to adjust the first and second positions for changing the controlling zone heating and air conditioning dynamics.

18. The method of claim 15, wherein said step of locking said first and second adjustment levers in place involves locking a single locking mechanism.

19. An adjustable damper actuator comprising:

a mover mechanism;

a moving mechanism connected to said mover mechanism, the mover mechanism configured to move the moving mechanism during normal operation of the moving mechanism; and an adjustable limit mechanism coupled to said moving mechanism, the adjustable limit mechanism including a single locking mechanism and first and second independent adjustment mechanisms for limiting a range of movement of the moving mechanism during normal operation to an adjustable range of movement, wherein said single locking mechanism is configured such that in an unlocked position, the first and second adjustment mechanisms are independently adjustable for limiting both ends of the range of movement of the moving mechanism, and when in a locked position, the first and second adjustment mechanisms are locked in position.

20. The actuator of claim 19, wherein said moving mechanism is for moving a damper.

21. The actuator of claim 19, wherein the ends of the range of movement of the moving mechanism correspond to:

a first position; and a second position.

22. The actuator of claim 21, wherein said single locking mechanism includes a wing nut, and the first and second adjustment mechanisms are freely slidable levers that are rotated in a planar arc to set the first position and to set the second position.

23. The actuator of claim 22, wherein:

said mover mechanism is activated to attain the first position of said moving mechanism; and said mover mechanism is non-activated to attain the second position of said moving mechanism.

24. The actuator of claim 23, wherein:

the first position corresponds to a position between a partially open and a fully open position of a damper; and the second position corresponds to a position between a partially closed and a fully closed position of the damper.

25. The actuator of claim 24, wherein said mover mechanism is activated or non-activated to control zone heating and air conditioning.

26. The actuator of claim 23, wherein:

the first position corresponds to a position between a partially closed and a fully closed position of a damper; and the second position corresponds to a position between a partially open and a fully open position of the damper.

27. The actuator of claim 26, wherein said mover mechanism is activated or non-activated to control zone heating and air conditioning.

28. The actuator of claim 19, wherein said adjustable limit mechanism includes at least one adjustable lever.

29. An adjustable damper actuator comprising:

a motor;

a shaft connected to said motor;

a first adjustable mechanical stop connected to said shaft, said first stop is a lever with a handle; and a second adjustable mechanical stop connected to said shaft, said second stop is a lever with a handle; and wherein:

said shaft is configured to move a damper during normal operation of the damper;

said first adjustable mechanical stop sets a semi-open position of the damper by rotating the lever by sliding the handle in an arc;

said second adjustable mechanical stop sets a semi-closed position of the damper by rotating the lever by sliding the handle in an arc; and the semi-open position of the damper is a partially or completely opened position; and the semi-closed position of the damper is a partially or completely closed position; wherein the first and second adjustable mechanical stops are configured to stop movement of the damper between the semi-open position and the semi-closed position during normal operation of the damper.

30. The actuator of claim 29, wherein:

said first lever is rotated around an axis substantially parallel to an axis of said shaft to adjust the semi-open position of the damper; and said second lever is rotated around an axis substantially parallel to an axis of said shaft to adjust the semi-closed position of the damper.

31. The actuator of claim 30, wherein:

said first and second adjustable mechanical stops further comprise a single mechanism for securing positions of the first and second levers after adjustment.

32. The actuator of claim 31, wherein:

when said motor is energized, the damper is put into the semi-open position; and when said motor is non-energized, the damper is put into the semi-closed position.

33. The actuator of claim 32, wherein zone control of heating and air conditioning is effected by energizing and non-energizing said motor.

34. The actuator of claim 31, wherein:

when said motor is energized, the damper is put into the semi-closed position; and when motor is non-energized, the damper is put into the semi-open position.

35. The actuator of claim 34, wherein zone control of heating and air conditioning is effected by energizing and non-energizing said motor.

36. A damper actuator for actuating a damper in a vent or duct, the damper having a fully open and a fully closed position, the damper moving between the fully open and fully closed positions during normal operation of the damper, the damper actuator comprising:

a drive mechanism for driving said damper during normal operation of the damper;

first and second stop mechanisms for stopping the damper at first and second positions between the fully closed and fully open positions during normal operation of the damper; and a single locking mechanism for selectively locking said first and second stop mechanisms.

37. A system for actuating a damper in a vent or duct, the damper having a fully open and a fully closed position, the system comprising:

an adjustable damper that moves between an at least partially open position and an at least partially closed position during normal operation of the damper; and an adjustable stop mechanism for preventing the damper from reaching the fully open position and/or a fully closed position during normal movement of the damper, wherein said adjustable stop mechanism is moved to a desired position and secured, thereby changing the position(s) at which the damper stops; wherein said adjustable stop mechanism includes first and second adjustable stop levers and a single locking mechanism that locks both the first and second stop levers in position.

38. The system of claim 37, wherein the first and second stop levers are independently adjustable.

39. A damper actuator for actuating a damper in a vent or duct, the damper having a fully open and a fully closed position, the damper actuator comprising:

a housing;

a drive shaft for moving the damper during normal operation of the damper, the drive shaft extending into the housing;

a drive mechanism for rotating said drive shaft in a first direction, the drive mechanism disposed in the housing;

a first adjustment lever including a first tab for permitting said drive shaft to rotate a certain amount in the first direction as determined by a first set adjustment position of the first adjustment lever, wherein said first lever is selectively locked to the housing with the first tab extending into the housing, the first tab interfering with the action of the drive mechanism, thereby stopping the drive shaft in a first position;

a second adjustment lever including a second tab for permitting said drive shaft to rotate an amount in a second direction as determined by a second set adjustment position of the second adjustment lever, wherein said second lever is selectively locked to the housing with the second tab extending into the housing, the second tab interfering with the action of the drive mechanism, thereby stopping the drive shaft in a second position; and a single reversible locking mechanism for locking said first and second adjustment levers in said first and second set adjustment positions, the single reversible locking mechanism disposed outside the housing.

40. The damper actuator of claim 39, further comprising a spring for providing rotational tension to said drive shaft in the second direction.

* * * * *